US007735743B2

(12) United States Patent
Jaeschke

(10) Patent No.: US 7,735,743 B2
(45) **Date of Patent: *Jun. 15, 2010**

(54) APPARATUS AND METHODS FOR VARIABLE FURNACE CONTROL

(75) Inventor: Horst Eric Jaeschke, Jefferson County, MO (US)

(73) Assignee: Emerson Electric Co., St. Louis, MO (US)

( * ) Notice: Subject to any disclaimer, the term of this patent is extended or adjusted under 35 U.S.C. 154(b) by 1036 days.

This patent is subject to a terminal disclaimer.

(21) Appl. No.: 11/453,305

(22) Filed: Jun. 14, 2006

(65) Prior Publication Data

US 2007/0003891 A1 Jan. 4, 2007

Related U.S. Application Data

(63) Continuation of application No. 10/232,609, filed on Aug. 30, 2002, now Pat. No. 7,101,172.

(51) Int. Cl.
*F23N 1/02* (2006.01)
*F23N 3/00* (2006.01)

(52) U.S. Cl. ..... 236/11; 236/15 BD; 236/15 C; 431/19

(58) Field of Classification Search ..... 236/11, 236/15 BR, 15 BD, 15 C; 431/18, 19
See application file for complete search history.

(56) References Cited

U.S. PATENT DOCUMENTS

| | | | | |
|---|---|---|---|---|
| 4,340,355 | A * | 7/1982 | Nelson et al. | 431/20 |
| 5,806,440 | A * | 9/1998 | Rowlette et al. | 110/162 |
| 5,819,721 | A * | 10/1998 | Carr et al. | 126/116 A |
| 6,257,870 | B1 * | 7/2001 | Hugghins et al. | 431/18 |
| 6,866,202 | B2 * | 3/2005 | Sigafus et al. | 236/11 |

* cited by examiner

*Primary Examiner*—Marc E Norman
(74) *Attorney, Agent, or Firm*—Harness, Dickey & Pierce, P.L.C.

(57) ABSTRACT

A furnace control system for controlling a gas-fired induced-draft furnace having a variable speed inducer blower. A control apparatus, responsive to a signal corresponding to the magnitude of a pressure difference between an inlet and outlet of the combustion chamber, controls blower motor speed to maintain the pressure difference at a predetermined magnitude corresponding to a selected gas flow rate. Inducer blower motor speed is varied directly and precisely to maintain an optimal pressure drop across the combustion chamber. The control system can be used in multi-stage and modulating furnace systems and in furnace systems utilizing pressure-assist modulating gas values.

4 Claims, 10 Drawing Sheets

APPARATUS AND METHODS FOR VARIABLE FURNACE CONTROL

CROSS-REFERENCE TO RELATED APPLICATIONS

This application is a continuation of U.S. patent application Ser. No. 10/232,609, filed Aug. 30, 2002, now U.S. Pat. No. 7,101,172 the entire disclosure of which is incorporated herein by reference.

FIELD OF INVENTION

This invention relates generally to gas furnaces and, more particularly, to variable furnace control in multi-stage and modulating furnace systems.

BACKGROUND OF THE INVENTION

In an induced-draft gas furnace, a gas valve typically establishes the flow of gas into a combustion chamber while a motor-controlled blower induces air and combustion gases through the combustion chamber. Variable draft-induced gas furnaces are generally of two types: multi-stage systems and modulating systems. In a typical multi-stage system, the blower motor has several fixed speeds and the gas valve has several fixed outlet pressures. When the user of a multi-stage system selects a thermostat setting, the system signals the gas valve to supply gas to the combustion chamber at a fixed rate corresponding to the selected thermostat setting. The system also signals the blower motor to induce a draft through the combustion chamber at a fixed rate corresponding to the gas flow rate.

A multi-stage system typically changes blower speeds based on input from one or more pressure switches. Such a switch can be triggered to switch on or off when pressure to or from the inducer blower exceeds or goes below a predetermined pressure value. However, other than indicating that a specific switch trigger pressure has been reached, a pressure switch does not provide the multi-stage system with information as to actual magnitudes of blower pressure on either side of the trigger value. Thus a multi-stage system can operate only at a few preset combinations of gas valve pressure and inducer blower speed. Operation may change from one to another of these combinations based on an imprecise gauge of blower pressure.

Modulating systems typically utilize variable-speed blower motors and electronically modulating gas valves. Modulating systems vary the gas valve outlet pressure by varying an electronic signal to the gas valve. Thus a modulating system can provide more precise control over gas flow than possible in a conventional multi-stage system. Another electronic signal that varies proportionately with the signal to the gas valve is used to vary the blower motor speed. Like multi-stage systems, modulating systems typically vary combustion levels based on trigger values for several pressure switches, but otherwise cannot sense inducer blower pressure levels. Thus, even though the speed of an inducer blower motor can be modulated, blower motor speed is varied imprecisely and indirectly. Such imprecise adjustments to air pressure and gas input to the combustion chamber do not always provide optimal air-to-gas ratios for combustion.

SUMMARY OF THE INVENTION

The present invention, in one embodiment, is directed to a furnace control system for controlling a gas-fired induced-draft furnace. The furnace has a variable speed motor-driven blower that draws combustion air through a combustion chamber. The system includes a control apparatus configured to select a flow rate of gas through a gas valve to the combustion chamber. The control apparatus is further configured to, responsive to a signal corresponding to the magnitude of a pressure difference between an inlet and an outlet of the combustion chamber, control speed of the blower motor to maintain the pressure difference at a predetermined magnitude corresponding to the selected gas flow rate.

The above-described furnace control system makes it possible to vary the speed of an inducer blower motor directly and precisely, so that the blower maintains a pressure drop across the combustion chamber that is optimal for the selected gas flow rate. The above-described furnace control system can be used in multi-stage and modulating furnace systems. The control system can be used not only in furnace systems that utilize electronically modulating gas valves, but also in furnace systems utilizing pressure-assist modulating gas valves.

DETAILED DESCRIPTION OF THE INVENTION

Figure 1:
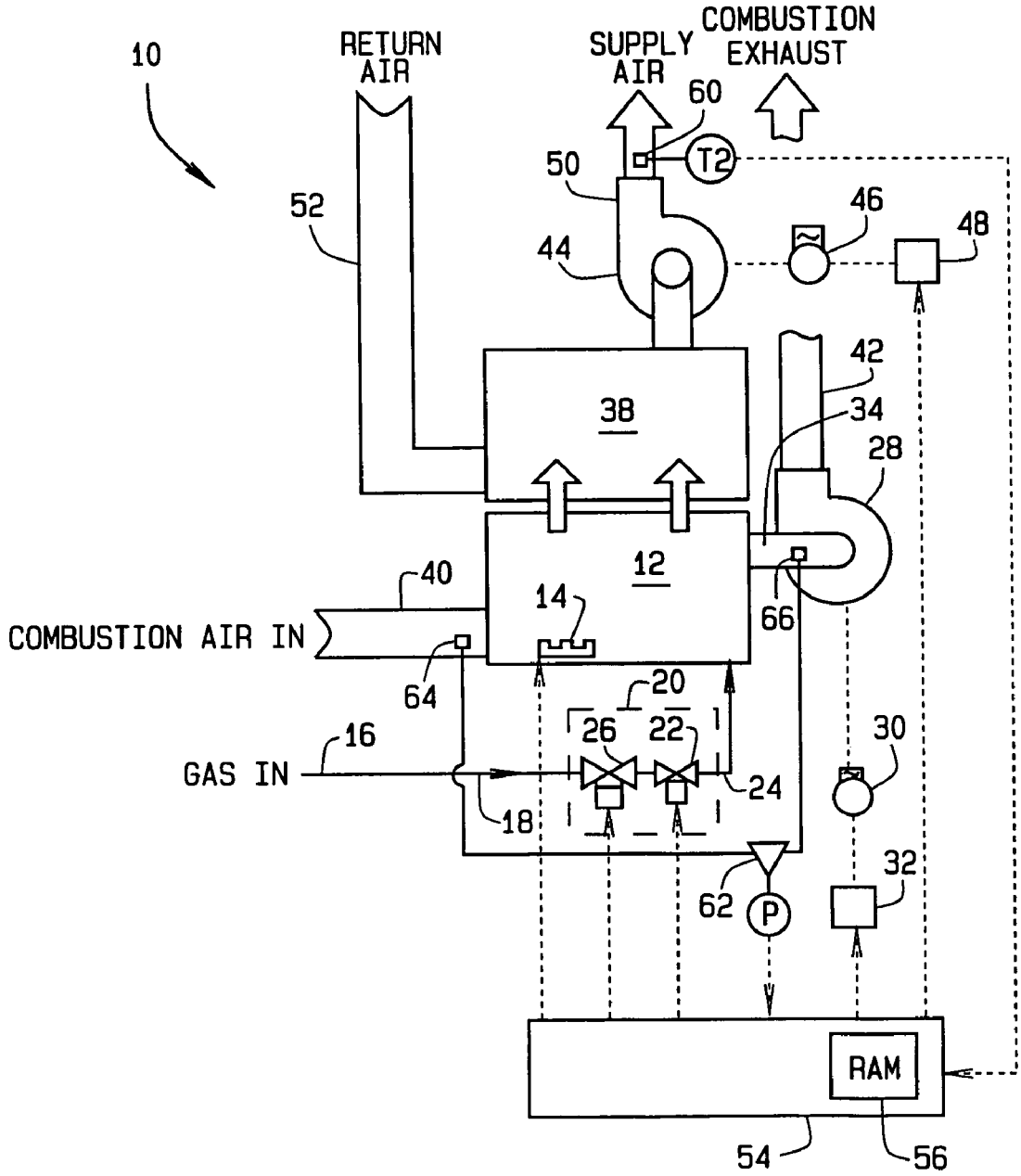
FIG. 1 is a schematic diagram of a variable induced draft modulating furnace system including an electronic modulating gas valve and a furnace control system according to one embodiment of the present invention.

A variable modulating furnace system according to one embodiment of the present invention is indicated generally by reference number 10 in FIG. 1. The system 10 includes a combustion chamber or burner box 12 having a burner 14 therein. Gas enters a gas inlet 16 and flows through a flow path 18 to the burner box 12. An electronic modulating gas valve 20 in the gas flow path 18 controls the flow of gas to the burner 14. The gas valve 20 includes a main valve 22 in the flow path 18 adjacent an outlet 24 of the gas valve. A safety or shutoff valve 26 is disposed in the flow path 18 between the inlet 16 and the main valve 22.

An inducer blower 28 is driven by a motor 30 under control of a variable-frequency drive 32. The blower 28 is connected to the burner box 12 via a blower inlet 34. The blower 28 draws hot combustion gases from the burner box 12 to a heat exchanger 38, thereby drawing combustion air through an air inlet 40 into the burner box 12. Combustion exhaust leaves the blower 28 through an exhaust outlet 42 and is vented to the atmosphere. Heated air is drawn from the heat exchanger 38 by a circulation blower 44. The blower 44 is driven by a motor 46 under control of a variable-frequency drive 48. The blower 44 supplies the heated air via an outlet 50 to the interior space being heated. Return air from the interior space enters the heat exchanger 38 through an inlet 52.

Gas ignition in the system 10 is controlled by a control apparatus 54 having a random access memory (RAM) 56. The control apparatus 54 includes, for example, a processor such as a 72334 microprocessor from STMicroelectronics. As shall be described in greater detail below, the control apparatus 54 controls the furnace system 10 using information from a temperature sensor 60 configured to sense the temperature of air in the heated air outlet 50. The control apparatus 54 also receives information from a pressure sensing device 62 connected to a pressure tap 64 in the combustion air inlet 40 and a pressure tap 66 in the blower inlet (i.e. combustion chamber outlet) 34.

As shall be further described below, the sensing device 62 is configured for sensing pressure of a corrosive combustion gas. The device 62 generates an analog signal indicative of the magnitude of a difference between pressure at tap 64 and pressure at tap 66. Such devices include, for example, a DX8 micro-pressure sensor, a diaphragm-type mechanical sensor manufactured by Omron Corporation of Tokyo, Japan. The sensing device 62 produces, for example, a DC output voltage of between 0.5 volts and 3.0 volts, corresponding to an input differential pressure of between 0 and 2.5 inches of water column. Such output voltage signals are substantially linear relative to input differential pressures. The sensing device 62 can be pin-mounted to a circuit board (not shown) of the control apparatus 54, although alternative configurations also are contemplated.

The control apparatus 54 also can be used for controlling furnace systems that utilize pressure-assist modulating gas valves. For example, a variable modulating furnace system according to another embodiment of the present invention is indicated generally by reference number 110 in FIG. 2. The system 110 includes a combustion chamber or burner box 112 having a burner 114 therein. Gas enters a gas inlet 116 and flows through a flow path 118 to the burner box 112. A gas valve 120 in the gas flow path 118 controls the flow of gas to the burner 114. The gas valve 120 includes a main valve 122 in the flow path 118 adjacent an outlet 124 of the gas valve. A safety valve 126 is disposed in the flow path 118 between the inlet 116 and the main valve 122. The gas valve 120 is pressure-assist modulating, as shall be described further below.

An inducer blower 128 is driven by a motor 130 under control of a variable-frequency drive 132. The blower 128 is connected to the burner box 112 via a blower inlet 134. The blower 128 draws hot combustion gases from the burner box 112 to a heat exchanger 138, thereby drawing combustion air through an air inlet 140 into the burner box 112. Combustion exhaust leaves the blower 128 through an exhaust outlet 142 and is vented to the atmosphere. Heated air is drawn from the heat exchanger 138 by a circulation blower 144. The blower 144 is driven by a motor 146 under control of a variable-frequency drive 148. The blower 144 supplies the heated air via an outlet 150 to the interior space being heated. Return air from the interior space enters the heat exchanger 138 through an inlet 152.

Figure 2:
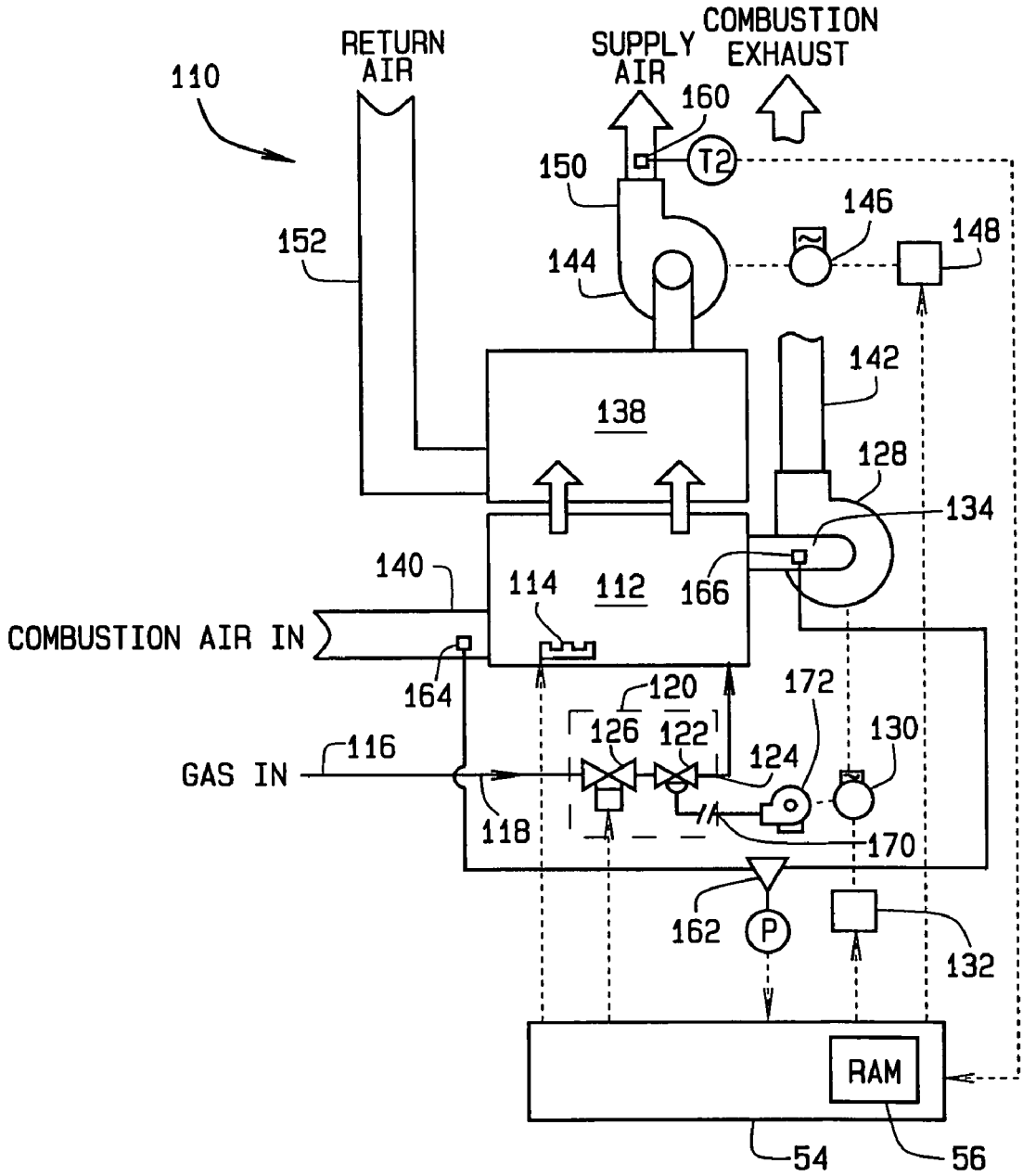
FIG. 2 is a simplified schematic diagram of a variable induced draft modulating furnace system including a pressure-assist modulating gas valve and a furnace control system according to one embodiment of the present invention.

The gas valve 120 is similar to conventional gas valves, except for the provision of a port 170 for receiving a pressure signal from the blower motor 130. More specifically, the gas valve 120 uses a pressure signal from a pump 172 slaved to the blower motor 130 to modulate the flow of gas to the burner 114. The pump 172, indicated schematically in FIG. 2, is operatively connected to the blower motor shaft and is responsive to blower motor speed. Such a pump and gas valve are described in co-pending U.S. patent application Ser. Nos. 10/020,548 and 09/903,484, assigned to the assignee hereof, the disclosures of which are incorporated herein by reference in their entirety. Based on the pressure signal received from the pump 172 via the port 170, the gas valve 120 increases the flow of gas to the burner 114 as the blower motor speed increases, and decreases the flow of gas to the burner as the blower motor speed decreases.

As shall be described in greater detail below, the control apparatus 54 controls the furnace system 110 using information from a temperature sensor 160 configured to sense the temperature of air in the heated air outlet 150. The control apparatus 54 also receives information from a pressure sensing device 162 connected to a pressure tap 164 in the combustion air inlet 140 and a pressure tap 166 in the blower inlet (i.e. combustion chamber outlet) 134.

As shall be further described below, the sensing device 162 is configured for sensing pressure of a corrosive combustion gas. The device 162 generates an analog signal indicative of the magnitude of a difference between pressure at tap 164 and pressure at tap 166. Such devices include, for example, a DX8 micro-pressure sensor, a diaphragm-type mechanical sensor manufactured by Omron Corporation of Tokyo, Japan. The sensing device 162 produces, for example, a DC output voltage of between 0.5 volts and 3.0 volts, corresponding to an input differential pressure of between 0 and 2.5 inches of water column. Such output voltage signals are substantially linear relative to input differential pressures. The sensing device 162 can be pin-mounted to a circuit board (not shown) of the control apparatus 54, although alternative configurations also are contemplated.

Figure 3:
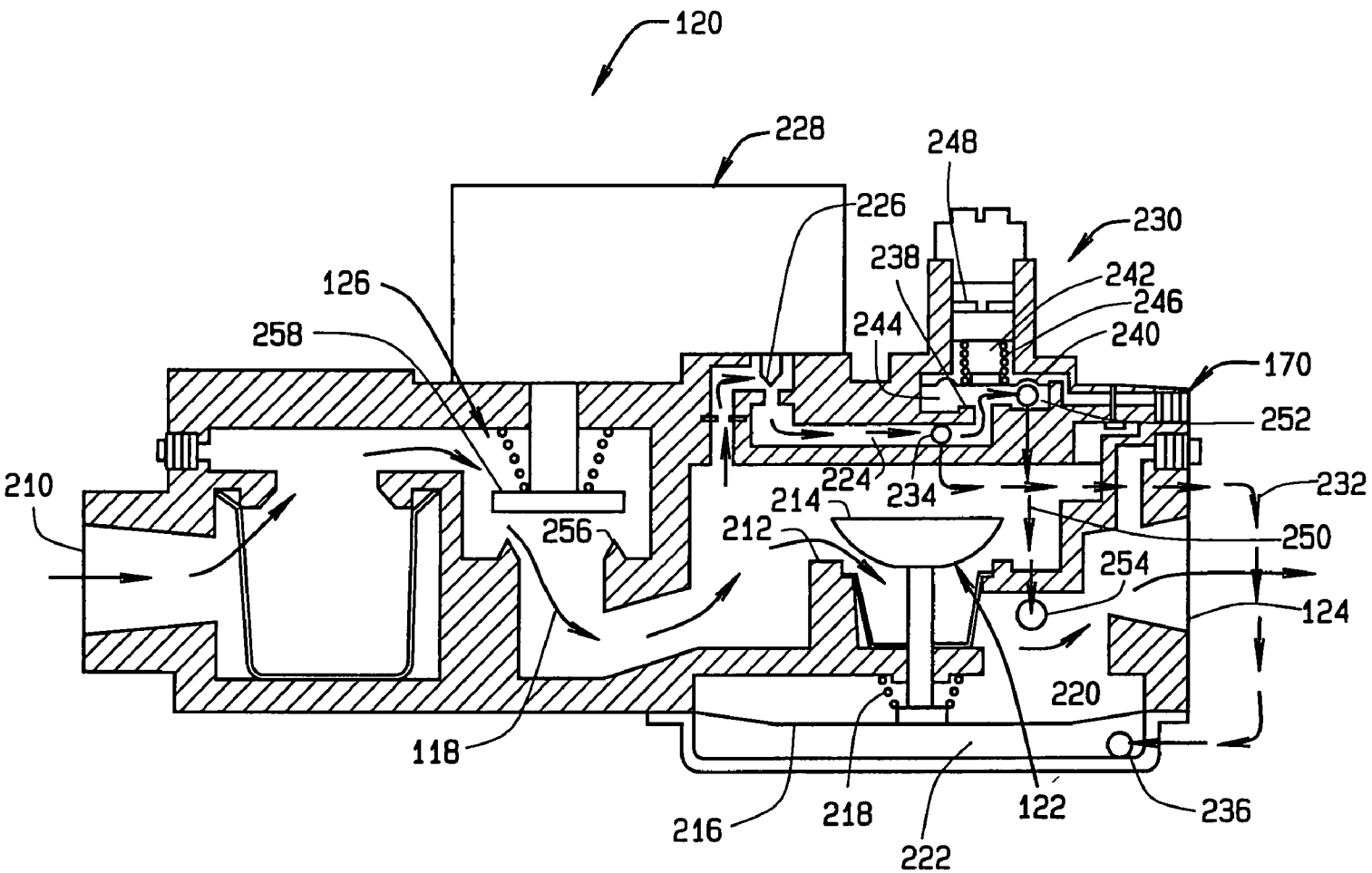
FIG. 3 is a vertical cross-sectional view of a pressure-assist modulating gas valve.
Figure 4A:
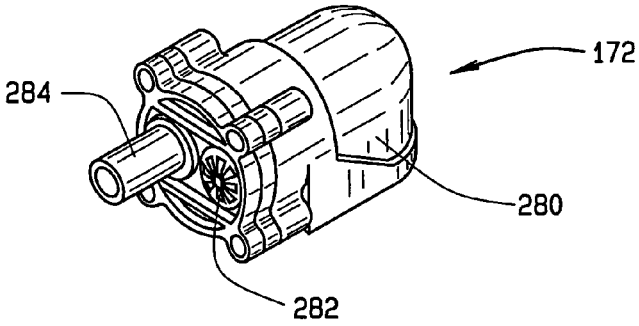
FIG. 4A is a perspective view of a pump adapted for use with a pressure-assist modulating gas valve.
Figure 4B:
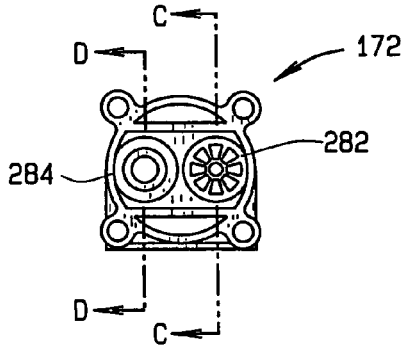
FIG. 4B is a front elevation view of the pump shown in FIG. 4A.
Figure 4C:
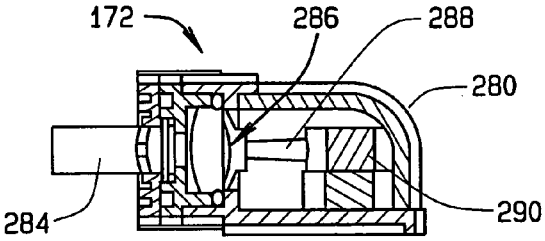
FIG. 4C is a vertical longitudinal cross-sectional view of the pump taken along the plane of line C-C in FIG. 4B.
Figure 4D:
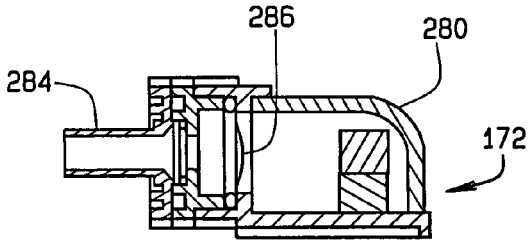
FIG. 4D is a vertical longitudinal cross-sectional view of the pump taken along the plane of line D-D in FIG. 4B.
Figure 4E:
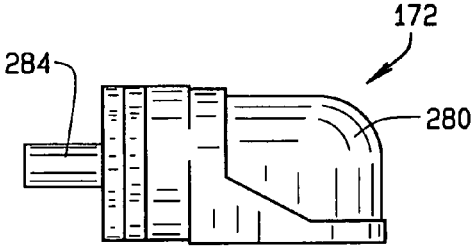
FIG. 4E is a side elevation view of the pump shown in FIG. 4A.
Figure 4F:
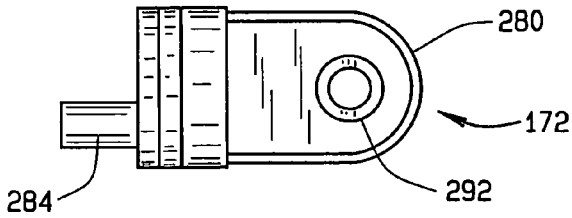
FIG. 4F is a bottom plan view of the pump shown in FIG. 4A.

The gas valve 120 is shown in greater detail in FIG. 3. The gas valve 120 has an inlet 210. The main valve 122 is adjacent the outlet 124. The main valve 122 has a valve seat 212 and a valve stem 214, which is controlled by a diaphragm 216, and is biased closed by a spring 218. The diaphragm 216 defines an upper chamber 220 and a lower chamber 222 in the valve 120. The relative pressures in the upper and lower chambers 220 and 222 determine the position of the valve stem 214 relative to the seat 212, and thus whether the flow path 118 in the valve 120 is open or closed.

A control conduit 224, selectively closed by a control valve 226 operated by a control solenoid 228, extends to a regulator 230. A passage 232 has a port 234 opening to the control conduit 224, and a port 236 opening to the lower chamber 222. Thus, when the control valve 226 is open, the inlet gas pressure is communicated via conduit 224 and passage 232 to lower chamber 222, which causes the stem 214 to move and open the main valve 122.

The regulator 230 includes a valve seat 238 and a diaphragm 240 that seats on and selectively closes the valve seat 238, and which divides the regulator into upper and lower chambers 242 and 244. There is a spring 246 in the upper, or vent, chamber 242 on one side of the diaphragm 240. The relative pressures in the upper and lower chambers 242 and 244 determine the position of the diaphragm 240 relative to the valve seat 238, and thus the operation of the regulator 230. A screw adjustment mechanism 248 compresses the spring 246 and adjusts the operation of the regulator 230. A passage 250 has a port 252 opening to the lower chamber 244 of the regulator 230, and a port 254 opening to the upper chamber 220 of the valve. When the regulator valve is open, i.e. when the diaphragm 240 is not seated on valve seat 238, the inlet gas pressure is communicated via passage 250 to the upper chamber 220, tending to equalize the pressure between the upper and lower chambers 220 and 222, and close the main valve 122.

The safety valve 126 includes a valve seat 256 and a valve member 258. The safety valve 126 is operated by the solenoid 228 and is disposed in the flow path 118 between the inlet 210 and the main valve 122. The safety valve 126 also closes the gas valve 120, acting as a back up to the main valve 122.

The regulator 230 includes the port 170 that communicates with the vent chamber 242 for receiving a pressure signal from the blower-motor-driven pump 172. The pressure signal on the port 170 changes the operating point of the regulator. When the pressure signal from port 170 increases the pressure in the vent chamber 242 of the regulator, the regulator valve closes passage 250, tending to increase the opening of the main valve 122. When the pressure signal from the port 170 decreases the pressure in the vent chamber 242 of the regulator, the regulator valve closes less readily, keeping passage 250 open, and tending to close the main valve. Thus the port 170 provides feed back control, increasing gas flow with an increase in blower speed, and decreasing gas flow with a decrease in blower speed.

The pump 172 is shown in greater detail in FIGS. 4A through 4F. The pump includes a housing 280 having a one-way air inlet 282 and an air outlet 284. A diaphragm 286 in the housing 280 is operated by the reciprocation of a shaft 288, which in turn is driven by a cam 290. The cam 290 is operatively connected to shaft of the blower motor. The pump 172 has a socket 292 for engaging the shaft of the blower motor. Thus the pressure generated by the pump changes with the speed of the blower motor.

Figure 5:
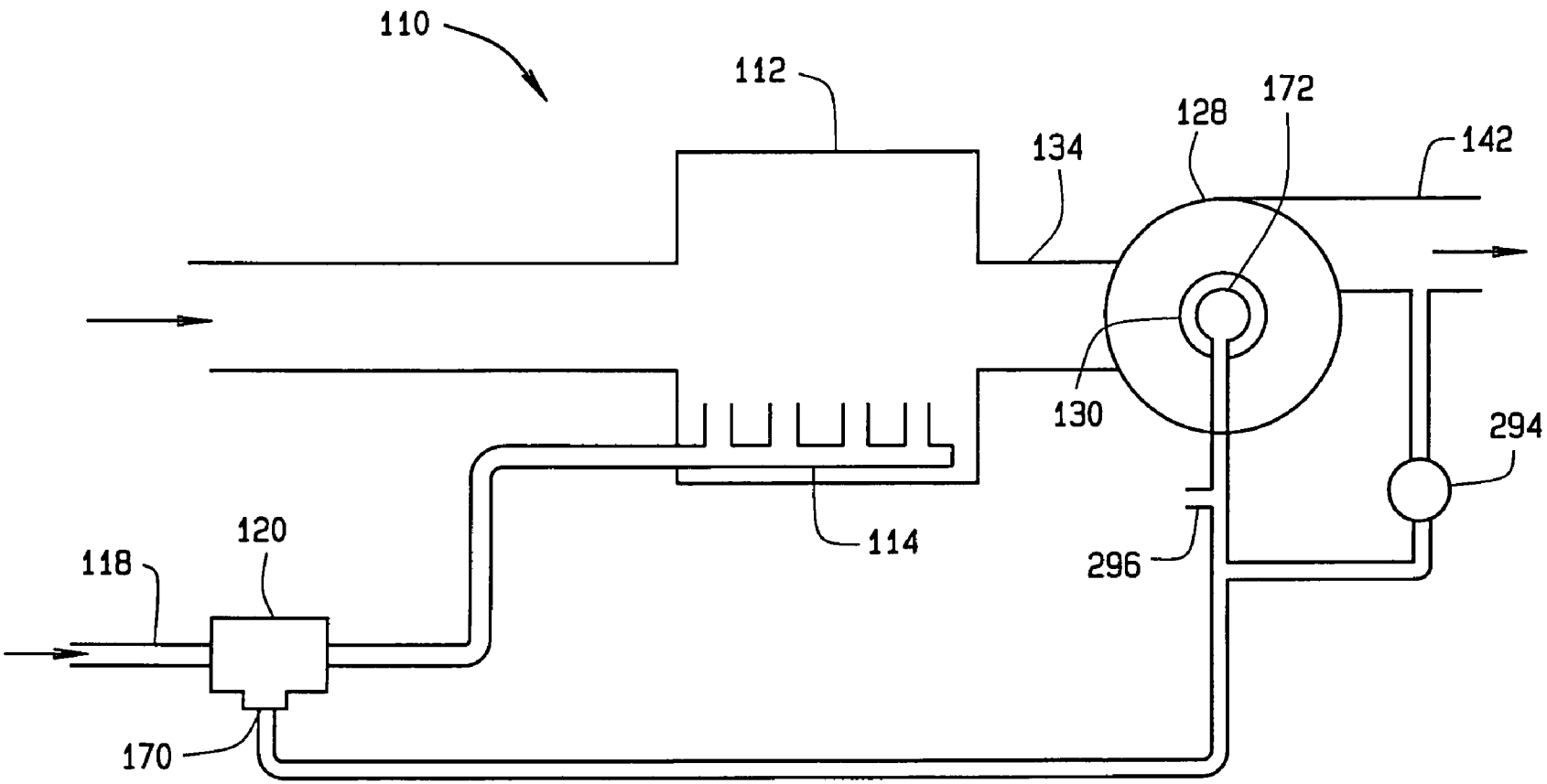
FIG. 5 is a diagram of a variable induced-draft modulating system including a pressure-assist modulating gas valve and a furnace control system according to one embodiment of the present invention.

FIG. 5 is a schematic diagram of the variable induced draft modulating furnace system 110. The control apparatus 54 also can use input from a differential pressure switch, indicated as 294 in FIG. 5. The switch 294 monitors a pressure difference between the output pressure of the blower 128 and the pressure signal from the pump 172 to the gas valve 120. The switch 294 is closed while the pressure difference is below a predetermined value. The switch 294 opens when the pressure difference exceeds the predetermined value. An elevated pressure difference could indicate, for example, the presence of a blocked flue. In the embodiment shown in FIG. 5, the pressure signal to the gas valve 120 can be adjusted using a bleed orifice 296.

Figure 6A:
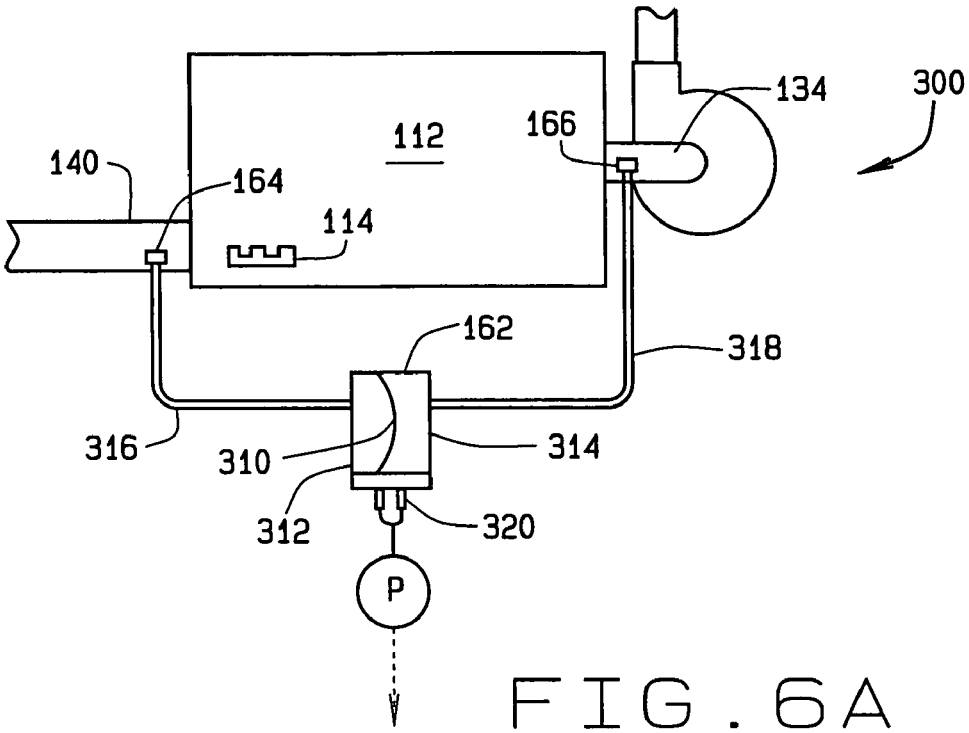
FIG. 6A is a diagram of a pressure sensing apparatus according to one embodiment of the present invention.

The analog pressure sensing device 162 is shown in greater detail in an embodiment of a pressure sensing apparatus indicated generally by reference 300 in FIG. 6A. The sensing device 162 includes a diaphragm 310 separating a first pressure side 312 from a second pressure side 314. The diaphragm 310 is fabricated, for example, of stainless steel. A hose 316 between the pressure tap 164 and the first pressure side 312 allows air from the combustion air inlet 140 to enter the first pressure side 312. A hose 318 between the pressure tap 166 and the second pressure side 314 allows combustion gases from the blower inlet 134 to enter the second pressure side 314. During normal operation of the furnace system 110, pressures within the first pressure side 312 typically exceed pressures within the second pressure side 314. A voltage signal, output via two pins 320 and delivered to the control apparatus 54, is indicative of a differential pressure P between the two sides 312 and 314.

Figure 6B:
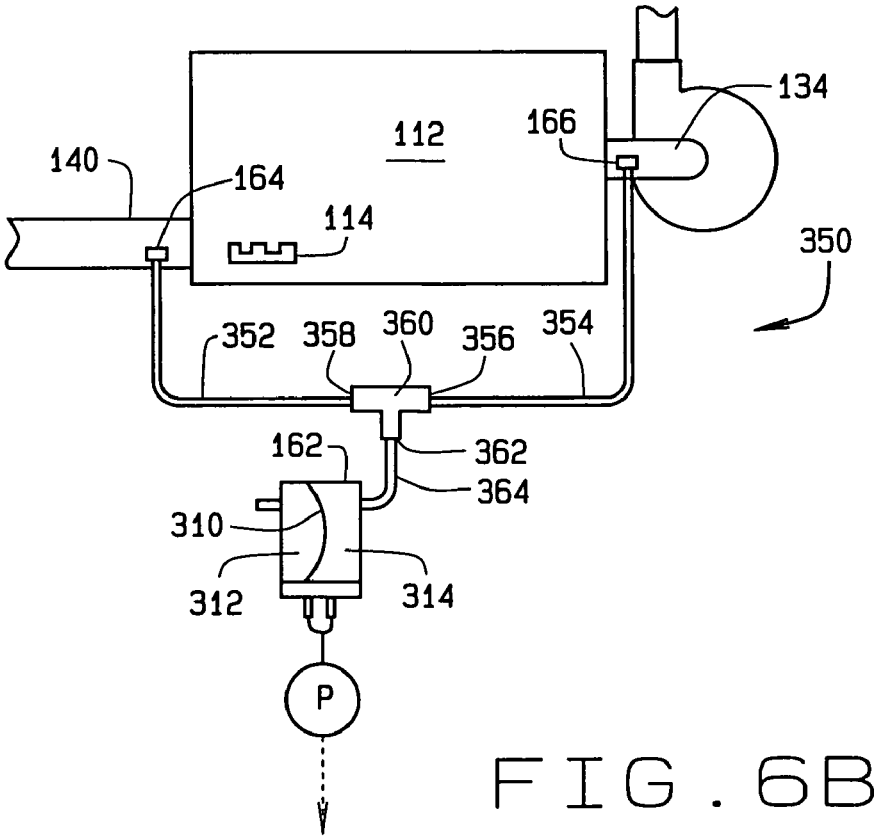
FIG. 6B is a diagram of a pressure sensing apparatus according to one embodiment of the present invention.

A preferred embodiment of a pressure sensing apparatus is generally indicated by reference number 350 in FIG. 6B. Two hoses 352 and 354 pneumatically connect the combustion air inlet 140 and the blower inlet 134 to ends 356 and 358 of a hollow "T" fitting 360. A third end 362 of the "T" fitting 360 is pneumatically connected via a hose 364 to the second pressure side 314 of the sensing device 162. The first pressure side 312 is open to ambient pressure. Thus a flow can be established that imparts a negative pressure to the second pressure side 314 and thereby serves to reduce effects of corrosive gases on the sensing device 162.

Operation of the control apparatus 54 shall be described with reference to FIGS. 7A through 7F. It is contemplated that the following described methods could be embodied in firmware, software and/or hardware in the control apparatus 54. The methods described with reference to FIGS. 7A through 7F are exemplary, and such methods can be interrelated and/or modified in a plurality of ways for operation of a furnace system via the control apparatus 54. The following described methods can be used in connection with the system 10 and/or in the system 110. It should be noted generally that although embodiments of the present invention are described herein with reference to modulating furnace systems, the invention is not so limited. The invention also can be practiced in connection with multi-stage furnace systems. Thus the term "stage" as used herein and in the claims can refer not only to a heating stage of a multi-stage system, but also to a combustion level of a modulating furnace system.

Figure 7A:
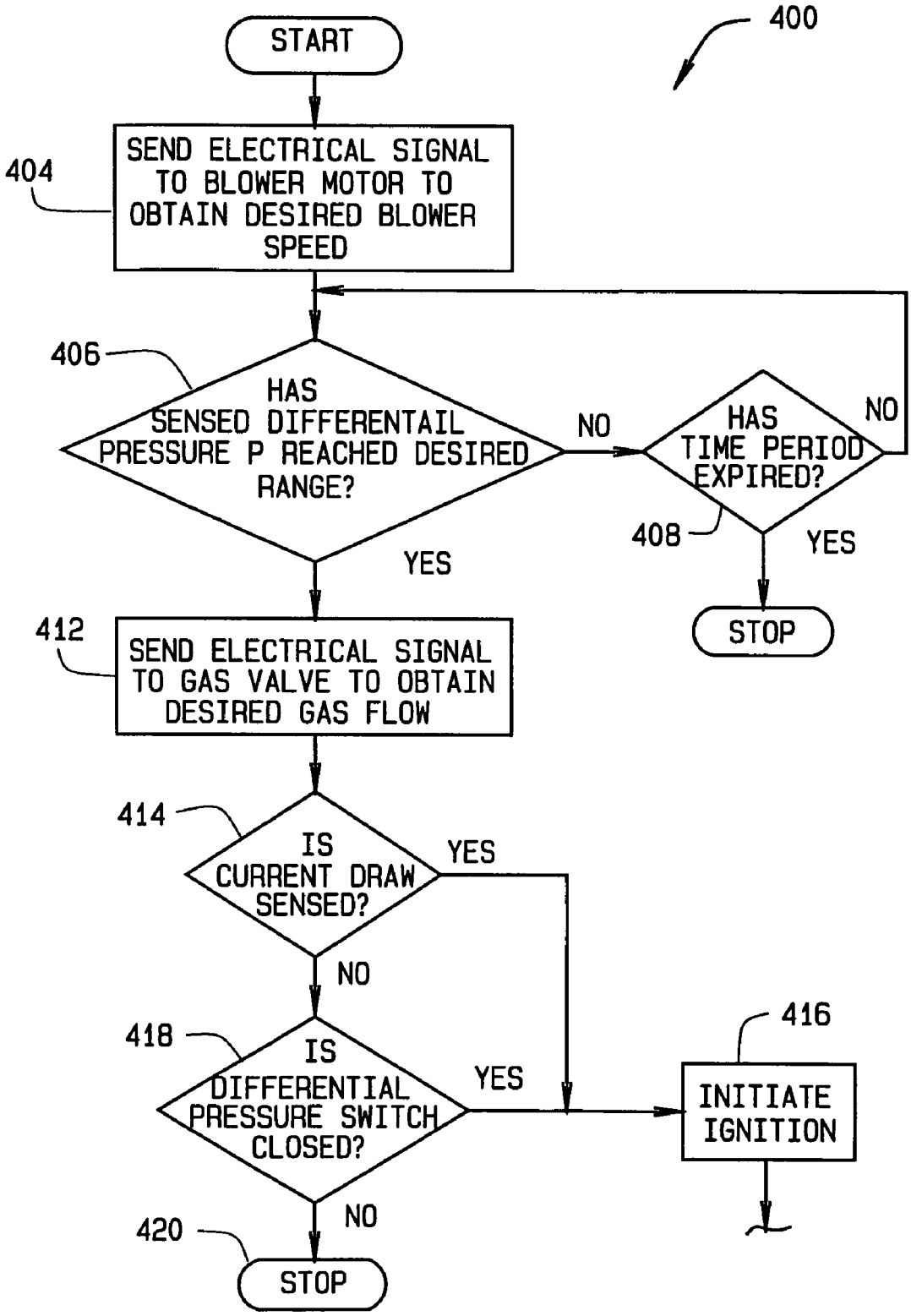
FIG. 7A is a flow diagram of a method for initiating ignition of a furnace system according to one embodiment of the present invention.

A method for initiating ignition of a furnace system such as system 10 and/or system 110 via the control apparatus 54 is indicated generally by reference number 400 in FIG. 7A. The method 400 is useful for determining the type of furnace system to be controlled, i.e. whether the system to be controlled by the apparatus 54 has an electronic modulating gas valve or a pressure-assist modulating gas valve.

At step 404, the control apparatus 54 sends an electrical signal to the blower motor 30 (or 130, as the case may be) to establish a desired blower speed. At step 406, the apparatus 54 checks pressure as indicated by the analog pressure sensing device 62 (or 162, as the case may be). If at step 408 the sensed differential pressure does not reach a predetermined pressure within a predetermined time period, for example, ten seconds, at step 410 the apparatus 54 stops the inducer blower motor.

At step 412, the control apparatus 54 sends another electrical signal, which, in a furnace system such as the system 10 (shown in FIG. 1), would signal the main valve of an electronic modulating valve such as the valve 20 to establish a desired gas flow. Where a furnace system has an electronic modulating gas valve, the signal sent at step 412 causes the gas valve to draw current. However, in a furnace system such as the system 110, absent any electrical connection between the control apparatus 54 and the pressure-modulated valve 122, the electrical signal sent at step 412 does not draw current. Thus, at step 414, the control apparatus 54 senses whether the second signal causes current draw. If current draw is sensed, as would be the case in a system such as the system 10, the control apparatus 54 assumes the presence of an electronic modulating gas valve and initiates ignition at step 416.

Where current draw is not sensed at step 414, as would be the case, for example, in the system 110, the control apparatus 54 assumes the presence of a pressure-assist modulating gas valve. Accordingly, at step 418, the apparatus 54 senses whether the differential pressure switch 294 (shown in FIG. 5) is open or closed. If the control apparatus 54 senses a closed differential pressure switch 294, the apparatus 54 initiates ignition at step 416. If an open switch 294 is sensed, the apparatus 54 closes down the furnace system at step 420.

Figure 7B:
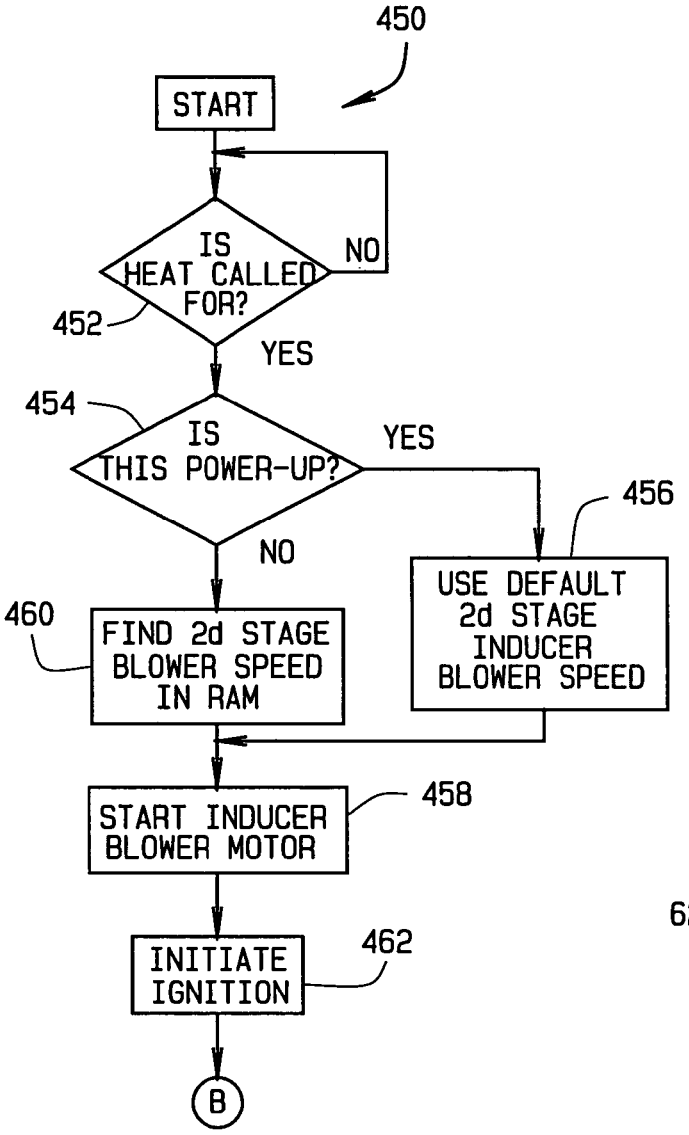
FIG. 7B is a flow diagram of a method for initiating ignition of a furnace system according to one embodiment of the present invention.

In other embodiments in which the control apparatus 54 is configured to control operation of a single type of furnace system, the method 400 is not used. Another method for initiating ignition of a furnace system such as system 10 and/or system 110 via the control apparatus 54 is indicated generally by reference number 450 in FIG. 7B. The method 450 and those shown in FIGS. 7C through 7F shall be described with reference to the system 110, although the following methods could also be used relative to the system 10. Referring to FIG. 7B, on a call for heat at step 452, it is determined at step 454 whether the system 110 has just been powered up. If the system 110 has just been powered up, at step 456 the control apparatus 54 retrieves a default second-stage speed of the inducer blower motor 130 and starts the motor 130 at step 458 using the default speed. If the system 110 is already powered up, the control apparatus 54 at step 460 looks up a value in the RAM 56 for the last second-stage speed of the motor 154 utilized by the system 110, as further described below, and starts the blower motor 154 at step 458 using the last-utilized speed. Ignition then is initiated at step 462.

Figure 7D:
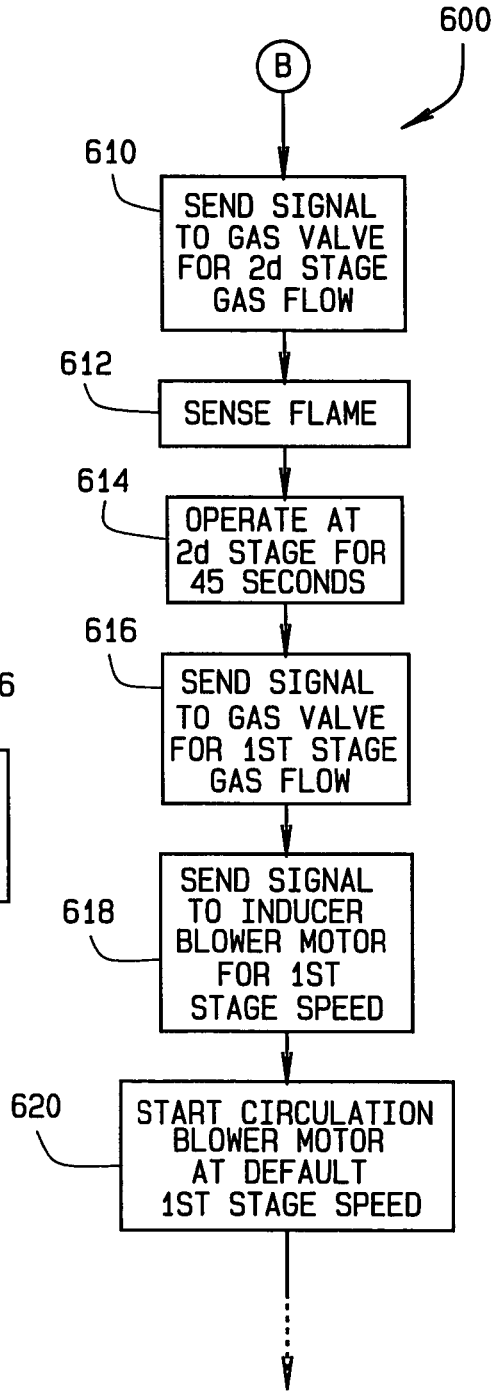
FIG. 7D is a flow diagram of a method for controlling a furnace system according to one embodiment of the present invention.
Figure 7C:
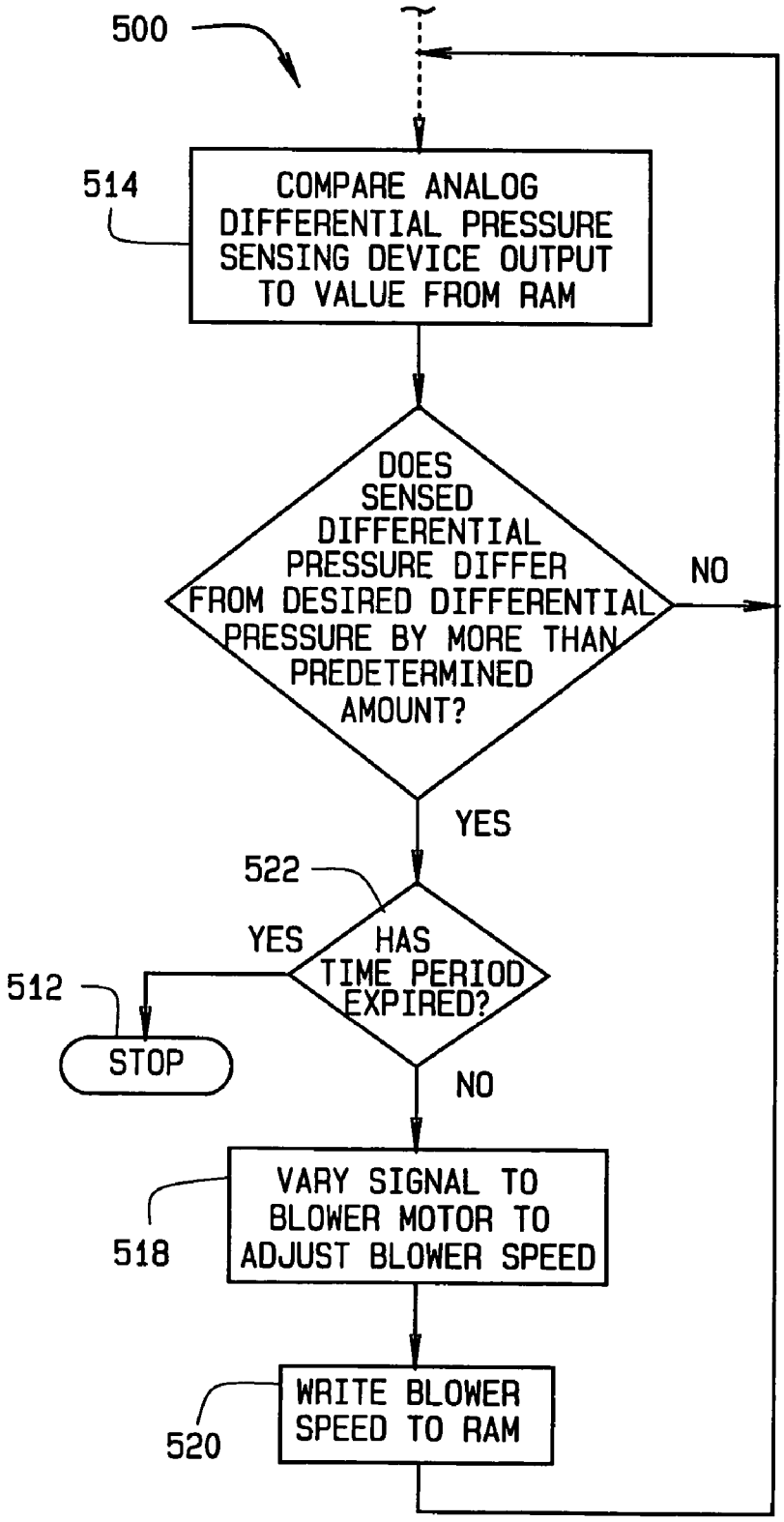
FIG. 7C is a flow diagram of a method for controlling a furnace system according to one embodiment of the present invention.
Figure 7E:
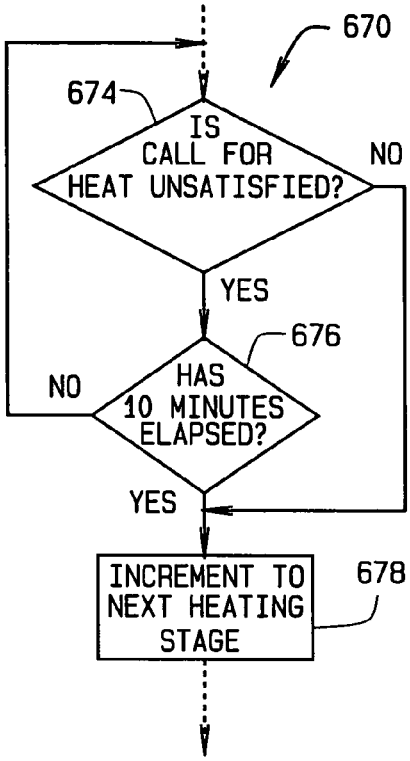
FIG. 7E is a flow diagram of a method for controlling a furnace system according to one embodiment of the present invention.

A method for controlling a furnace system is indicated generally by reference number 500 in FIG. 7C. The control apparatus 54 uses the speed value to set a pulse-width modulated (PWM) duty cycle, e.g., for an 85-hertz signal or serial interface signal to the inducer motor drive 132 for controlling the speed of the motor 130. As previously described, the control apparatus 54 receives a voltage signal from the analog pressure sensing device 162 indicative of a pressure change across the burner box 112. The inducer blower motor speed is continually adjusted via the control apparatus 54 to achieve a desired pressure drop, for example, for each stage of heating. The speed of the blower motor 130 during operation in any stage is continually written in the RAM 56 for recall on next start-up of any stage. The term "continual" includes the meaning "occurring at intervals as determined by the control apparatus 54".

Specifically, and referring to FIG. 7C, the control apparatus 54 at step 514 compares output of the analog differential pressure sensing device 162 to a desired differential pressure stored in the RAM 56, that corresponds to the desired gas flow through the gas valve 120. If the sensed differential pressure signal differs from the desired differential pressure by more than a predetermined amount, the apparatus 54 varies the signal to the blower motor 130 at step 518. The apparatus 54 thereby adjusts the blower motor speed, to achieve the desired analog pressure sensor signal, and at step 520 writes the adjusted blower motor speed to the RAM 56. If the desired differential pressure signal has not been detected before a predetermined time period of, for example, ten seconds has elapsed at step 522, the apparatus 54 shuts off the furnace system at step 512.

The control apparatus 54 may be used to operate the furnace system 110 at heating stages via a method indicated generally as 600 in FIG. 7D. After initiating ignition, for example, as shown in FIG. 7B, the control apparatus 54 sends a signal at step 610 to open the gas valve 120 at second-stage outlet flow. After sensing flame at step 612, the control apparatus 54 at step 614 continues to run at second stage for 45 seconds. The control apparatus 54 thereafter switches the gas valve 120 at step 616 to first-stage outlet flow. At step 618 the inducer blower motor 130 is signaled to run at first-stage speed, and at step 620 the circulator blower motor 146 is signaled to run at a default first-stage speed.

In an embodiment including a three-stage thermostat (not shown), the control apparatus 54 is configured to change heating stages via the thermostat. Where the control apparatus 54 is not connected with a three-stage thermostat, heating stages can be incremented and/or decremented via the control apparatus 54 using a method indicated generally as 670 in FIG. 7E. The control apparatus 54 determines at step 674 whether a call for heat remains unsatisfied. If a call is unsatisfied, the control apparatus 54 at step 676 operates at its current heating stage for up to a default time period, e.g. ten minutes, or until the call for heat is satisfied, before incrementing operation at step 678 to the next heating stage.

Figure 7F:
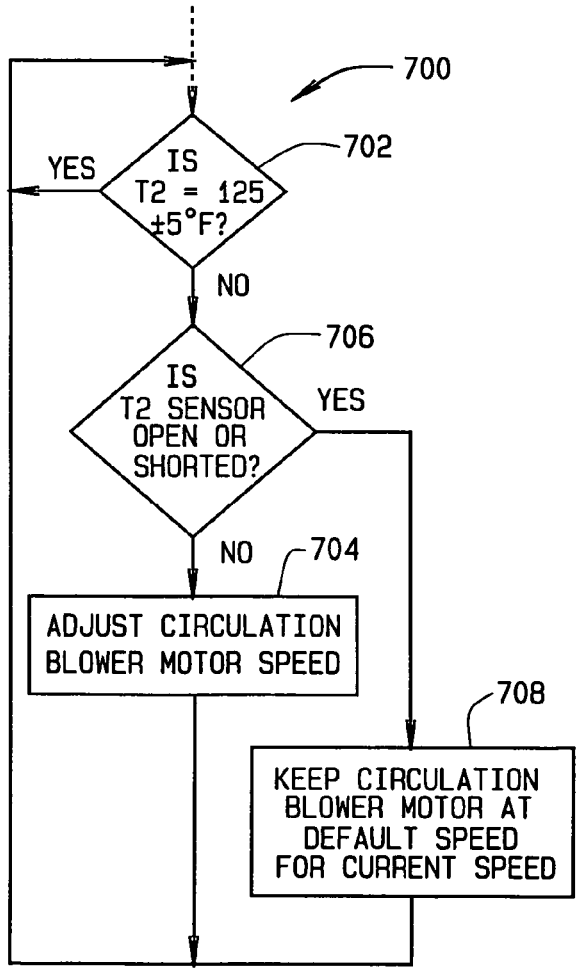
FIG. 7F is a flow diagram of a method for controlling a furnace system according to one embodiment of the present invention.

A method for controlling temperature of air leaving the heat exchanger 138 is indicated generally by reference number 700 in FIG. 7F. As shown in FIG. 7F, the control apparatus 54 can be used to continually adjust the circulator blower speed to hold the air exiting the heat exchanger to a temperature, for example, between about 120 and 130 degrees F. This speed is controlled by monitoring at step 702 the temperature T2 via sensor 160 in the exiting air. At step 704 the PWM duty cycle signal to the circulator blower motor 146 is adjusted responsive to temperature T2. If the sensor 160 is determined at step 706 to be shorted or open, the control apparatus 54 at step 708 keeps the circulator blower motor 146 at a predetermined default speed for each of the stages of operation.

The above-described furnace control system makes it possible to vary the speed of an inducer blower motor directly and precisely, so that the blower maintains a pressure drop across the combustion chamber that is optimal for the selected gas flow rate. Because blower speed can be adjusted based on specific magnitudes of differential pressure across the burner box, optimal air/gas ratios can be maintained in both multi-stage and modulating furnace systems. The control system can be used not only in furnace systems that utilize electronically modulating gas valves, but also in furnace systems utilizing pressure-assist modulating gas valves. Thus furnace systems using pressure-modulating gas valves can be controlled at a level of precision comparable to that at which systems with electronic gas valves can be controlled.

Other changes and modifications may be made to the above described embodiments without departing from the scope of the present invention, as recognized by those skilled in the art. Thus the invention is to be limited only by the scope of the following claims and their equivalents.

What is claimed is:

1. A furnace control system for controlling a gas-fired induced-draft furnace having a variable speed motor-driven inducer blower that draws combustion air through a combustion chamber, and a variable speed motor-driven circulator blower that circulates air heated by a heat exchanger, the system comprising:

a variable speed inducer blower configured to draw combustion air through a combustion chamber, the inducer blower being driven by a motor via a variable frequency drive;

a gas valve configured to establish a desired flow rate of gas to the combustion chamber;

a pressure sensing apparatus configured to sense a pressure difference between an inlet and an outlet of the combustion chamber and generate a signal that varies in value corresponding to a magnitude of the pressure difference; and a control apparatus having a memory, the control apparatus being configured to control the gas valve to select a flow rate of gas through the gas valve to the combustion chamber, and to receive the signal corresponding to the pressure difference and adjust the inducer blower motor's speed to achieve a desired pressure difference, and to store in the memory said speed of the inducer blower motor for recall on the next start-up;

where in response to a call for heat, the control apparatus is further configured to:

look up in the memory said speed last utilized by the inducer blower motor, and to start the inducer blower motor using said speed last utilized by the inducer blower motor that the control apparatus looks up in a memory; and select a flow rate of gas associated with said speed.

2. The system of claim 1, wherein the signal generated by the pressure sensing apparatus comprises an analog signal, and the control apparatus is further configured to adjust the speed of the inducer blower motor based on the value of the analog signal of the pressure sensing apparatus.

3. The system of claim 1, wherein the control apparatus is further configured to determine whether a gas valve of the furnace is electronically modulated or pressure-modulated.

4. The system of claim 1, wherein the stage is further associated with a predetermined pressure magnitude associated with the selected gas flow rate.

* * * * *